US008118575B2

(12) United States Patent
Williamson et al.

(10) Patent No.: US 8,118,575 B2
(45) Date of Patent: Feb. 21, 2012

(54) VARIABLE DISPLACEMENT VANE PUMP WITH ENHANCED DISCHARGE PORT

(75) Inventors: Matthew Williamson, Richmond Hill (CA); David R. Shulver, Richmond Hill (CA); Cezar Tanasuca, Richmond Hill (CA)

(73) Assignee: Magna Powertrain Inc., Concord (CA)

( * ) Notice: Subject to any disclaimer, the term of this patent is extended or adjusted under 35 U.S.C. 154(b) by 348 days.

(21) Appl. No.: 12/429,294

(22) Filed: Apr. 24, 2009

(65) Prior Publication Data

US 2009/0269232 A1 Oct. 29, 2009

Related U.S. Application Data

(60) Provisional application No. 61/047,801, filed on Apr. 25, 2008.

(51) Int. Cl.
*F04C 2/00* (2006.01)
*F04C 14/18* (2006.01)

(52) U.S. Cl. ..... 418/26; 418/27; 418/30; 418/104; 417/220

(58) Field of Classification Search ..... 418/26–30, 418/104; 417/220
See application file for complete search history.

(56) References Cited

U.S. PATENT DOCUMENTS

| | | | | |
|---|---|---|---|---|
| 2,651,994 | A | 9/1953 | De Lancey et al. | |
| 4,183,723 | A | 1/1980 | Hansen et al. | |
| 4,342,545 | A | 8/1982 | Schuster | |
| 5,090,881 | A * | 2/1992 | Suzuki et al. | 418/26 |
| 5,178,525 | A | 1/1993 | Murota | |
| 5,538,400 | A | 7/1996 | Konishi et al. | |
| 5,738,500 | A | 4/1998 | Sundberg et al. | |
| 5,895,209 | A | 4/1999 | Miyazawa | |
| 6,457,946 | B2 * | 10/2002 | Gretzschel et al. | 418/26 |
| 6,503,068 | B2 | 1/2003 | Kojima et al. | |
| 6,558,132 | B2 | 5/2003 | Hanggi | |
| 6,709,242 | B2 | 3/2004 | Watanabe et al. | |
| 7,128,542 | B2 | 10/2006 | Suzuki et al. | |
| 7,318,705 | B2 | 1/2008 | Uchino et al. | |
| 2007/0224067 | A1 | 9/2007 | Arnold et al. | |
| 2008/0099271 | A1 | 5/2008 | Ueki et al. | |
| 2008/0118372 | A1 | 5/2008 | Hoshina et al. | |
| 2008/0187446 | A1 | 8/2008 | Staley et al. | |
| 2008/0247894 | A1 | 10/2008 | Lutoslawski et al. | |

* cited by examiner

*Primary Examiner* — Theresa Trieu
(74) *Attorney, Agent, or Firm* — Harness, Dickey & Pierce, P.L.C.

(57) ABSTRACT

A variable displacement vane pump which includes an enhanced discharge port. The enhanced discharge port reduces areas of high pressure in the discharge port which would otherwise occur as the pressurized working fluid reverses its direction of flow to enter the discharge port. By reducing the areas of high pressure, the back torque on the pump rotor is reduced and the energy efficiency of the pump is enhanced. In one embodiment, the pivot for the pump control ring is located radially outwardly from a conventional location, to allow for a discharge recess to be formed in the control ring, adjacent the discharge port, and extending past the pivot to the pump outlet. In a second embodiment, the discharge recess is formed in the control ring around the pivot and a seal is provided on the control ring to inhibit leakage of pressurized working fluid past the control ring. In a third embodiment, a secondary discharge port is provided adjacent the discharge recess formed in the control ring and pressurized working fluid in the discharge recess can exit the discharge recess through the secondary discharge port which is in fluid communication with the pump outlet.

11 Claims, 10 Drawing Sheets

VARIABLE DISPLACEMENT VANE PUMP WITH ENHANCED DISCHARGE PORT

The application claims the benefits of U.S. Provisional Application No. 61/047,801, filed Apr. 25, 2008.

FIELD OF THE INVENTION

The present invention relates to a variable displacement vane pump. More specifically, the present invention relates to a variable displacement vane pump which includes an enhanced discharge port designed to improve energy efficiency of the pump.

BACKGROUND OF THE INVENTION

Until recently, fixed displacement pumps have conventionally been employed as lubrication oil pumps for internal combustion engines. To prevent possibly damaging oversupply of lubrication oil under some operating conditions, pressure relief valves or other control mechanisms have been used to route the oversupply of oil from the output of the pump back to a reservoir or the pump inlet.

While such systems have proven to be reliable and inexpensive, they suffer from a disadvantage in that energy is used by the pump to pressurize the oversupply of oil which is merely redirected to the pump inlet or reservoir by the control mechanism, and this energy is wasted, reducing the energy efficiency of the pump.

More recently, variable displacement vane pumps have been considered for use as lubrication oil pumps for internal combustion engines. By providing a suitable control mechanism to alter the displacement of the pump to provide only the amount of pressurized lubrication oil necessary for proper operation of the engine, no energy is required to pressurize unneeded oil and thus the energy efficiency of the pump, and the internal combustion engine, can be improved.

However, conventional designs of variable displacement vane pumps have proven to be less energy efficient than desired, especially at high displacement operating conditions.

It is desired to have a variable displacement vane pump which has an improved operating energy efficiency compared to conventional variable displacement vane pumps.

SUMMARY OF THE INVENTION

It is an object of the present invention to provide a novel variable displacement vane pump which obviates or mitigates at least one disadvantage of the prior art.

According to a first aspect of the present invention, there is provided a variable displacement vane pump, comprising: a rotor having a set of radially extending vanes; a control ring having an inner surface against which the vanes abut, adjacent vanes forming pumping chambers with the control ring and the rotor and the control ring being moveable about a pivot to alter the eccentricity of the axis of rotation of the vanes and the axis of rotation of the rotor to change the displacement of the pump; an inlet port to introduce working fluid from a pump inlet to the pumping chambers; a discharge port located downstream of the inlet port, with respect to the direction of rotation of the rotor, to transfer pressurized working fluid from the pumping chambers to a pump outlet; and a discharge recess formed in at least one of the upper and lower surfaces of the control ring adjacent the discharge port and in fluid communication with the discharge port to form an enhanced discharge port.

The present invention provides a variable displacement vane pump which includes an enhanced discharge port. The enhanced discharge port provides additional volume for pressurized fluid to exit the enhanced discharge port and reduces areas of high pressure in the discharge port which would otherwise occur as the pressurized working fluid reverses its direction of flow to enter the discharge port. By reducing the areas of high pressure, the back torque on the pump rotor is reduced and the energy efficiency of the pump is enhanced. In one embodiment, the pivot for the pump control ring is located radially outwardly from a conventional location, to allow for a discharge recess to be formed in the control ring, adjacent the discharge port, and extending past the pivot to the pump outlet. The combination of the discharge port and the discharge recess form an enhanced discharge port. In a second embodiment, the discharge recess is formed in the control ring around the pivot and a seal is provided on the control ring to inhibit leakage of pressurized working fluid past the control ring. In a third embodiment, a secondary discharge port is provided adjacent the discharge recess formed in the control ring and pressurized working fluid in the discharge recess can exit the discharge recess through the secondary discharge port which is in fluid communication with the pump outlet.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
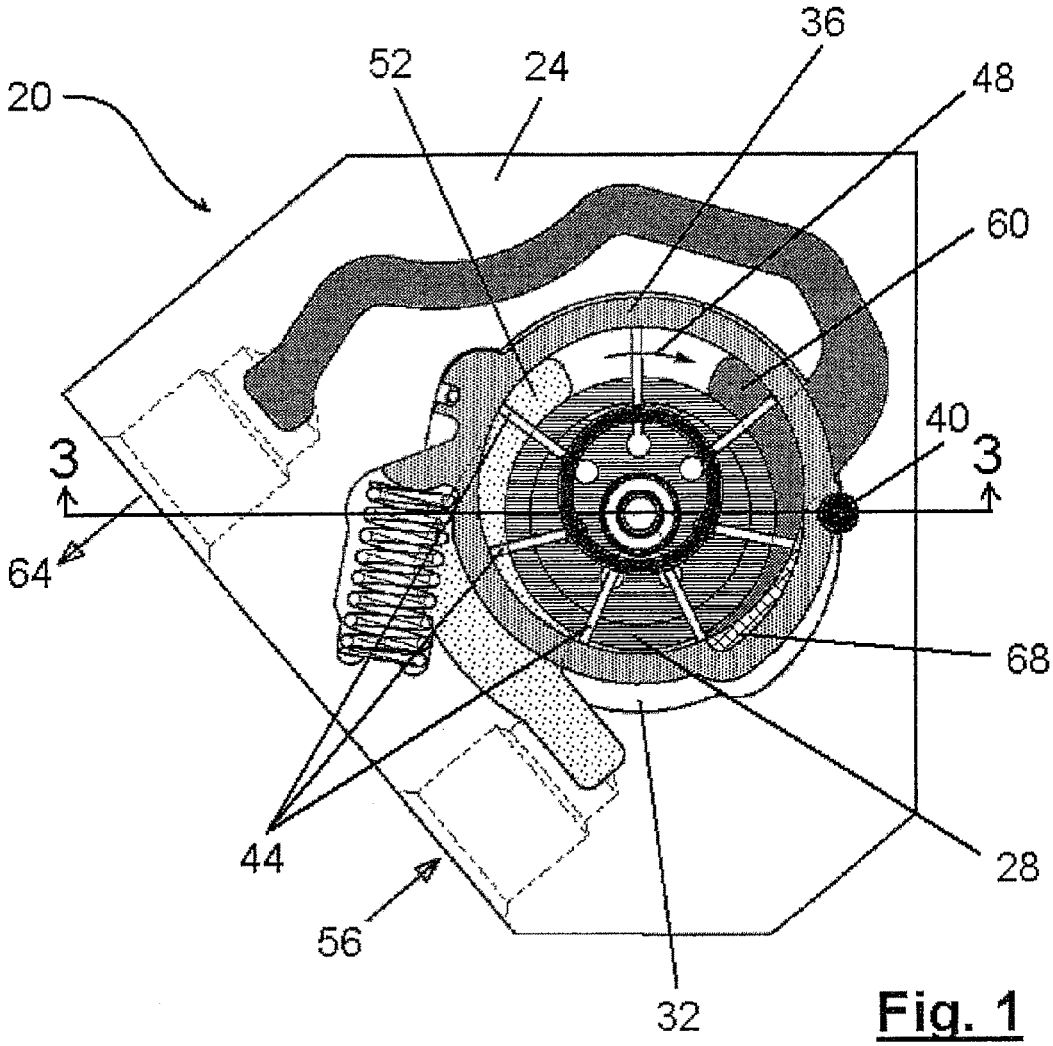
Fig. 1 (prior art)
FIG. 1 shows a cross section through a prior art variable displacement vane pump.

A prior art variable displacement vane pump is indicated generally at 20 in FIG. 1. Pump 20 includes a pump housing 24 and a rotor 28 which is located within a cavity 32 in housing 24. A control ring 36 is also located within cavity 32 and control ring 36 pivots about a pivot 40 to alter the degree of eccentricity of a set of vanes 44 extending from rotor 28 to change the displacement of pump 20.

As is well known to those of skill in the art, as rotor 28 turns (in the direction indicated by arrow 48), working fluid from an inlet port 52, which is connected to a pump inlet 56, is drawn into the pump chambers formed between adjacent vanes 44, rotor 28 and control ring 36. As rotor 28 turns, the volume of each of these pump chambers first increases, drawing working fluid into the pump chambers from inlet port 52, and then decreases as the pump chamber is brought into fluid connection with a discharge port 60 that is connected to a pump outlet 64. This decreasing volume results in the pressurization of the working fluid supplied to discharge port 60.

By pivoting control ring 36 about pivot 40, the eccentricity between the rotational center of vanes 44 and the rotational center of control ring 36 can be altered to vary the change in the volume of the pump chambers during a revolution of pump 20, thus varying its displacement. In FIG. 1, control ring 36 of pump 20 is in its maximum eccentricity position, i.e.—at the point of maximum volumetric displacement.

Figure 2:
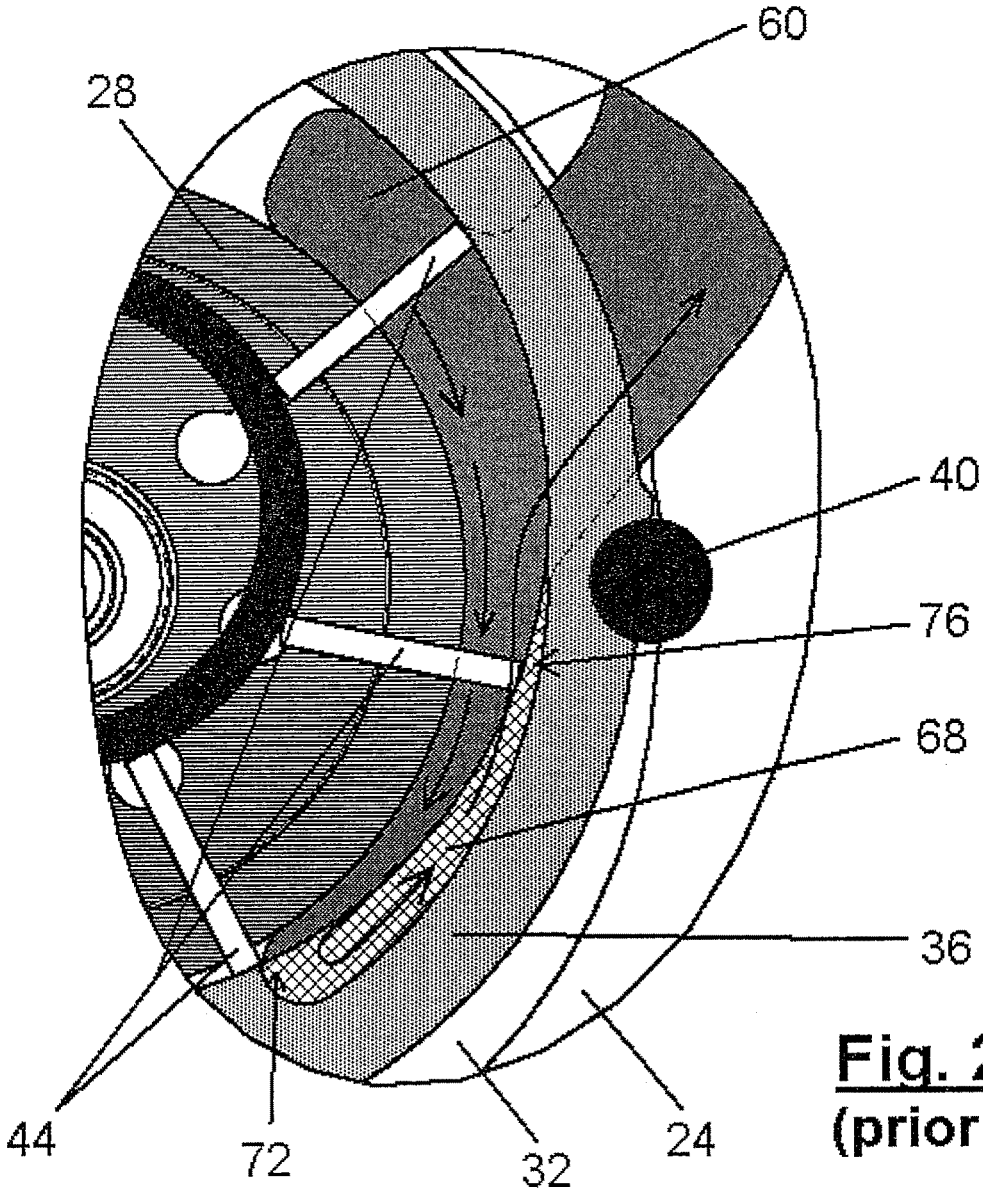
Fig. 2 (prior art)
FIG. 2 shows an enlarged view of a portion of the discharge port of the pump of FIG. 1 showing the flow of working fluid.

One of the known optimizations for vane pumps is the provision of a recess 68, referred to as a "teardrop recess" in the upper and lower surfaces of control ring 36 adjacent the narrowest end (i.e.—the downstream end) of discharge port 60. As the rotation of rotor 28 moves each vane 44, in turn, towards the downstream end of discharge port 60, the pressurized working fluid must undergo a reversal of its direction to exit discharge port 60, as indicated by the arrows in FIG. 2.

While recess 68 provides some additional flow area which assists in achieving the necessary reversal in direction of the working fluid, the present inventors have determined that a significant pressure increase occurs at the narrowest end 72 of discharge port 60 as the working fluid undergoes the reversal of direction. In particular, the narrowness of end 72 (most clearly seen in FIG. 3) strongly inhibits the necessary reversal of the pressurized working fluid, resulting in a significant pressure increase. This pressure increase results in a back torque force being applied to rotor 28 and requires additional input torque to be applied to rotor 28 to overcome the back torque.

Further, as the width of recess 68 necessarily tapers such that recess 68 ends at 76, adjacent pivot 40, to ensure for adequate sealing surfaces for control ring 36, the flow of working fluid through this area 76 is restricted which also contributes to the pressure increase and the back torque. Further still, the resulting back pressure increases with the viscosity of the working fluid and thus start up and/or cold operating conditions, especially at high displacement setting for the pump, will exacerbate the back torque.

As will be apparent to those of skill in the art, providing the input torque necessary to counteract the back torque results in an increased operating energy requirement for pump 20, with no useful benefit being obtained, thus decreasing the overall energy efficiency of pump 20.

Figure 4:
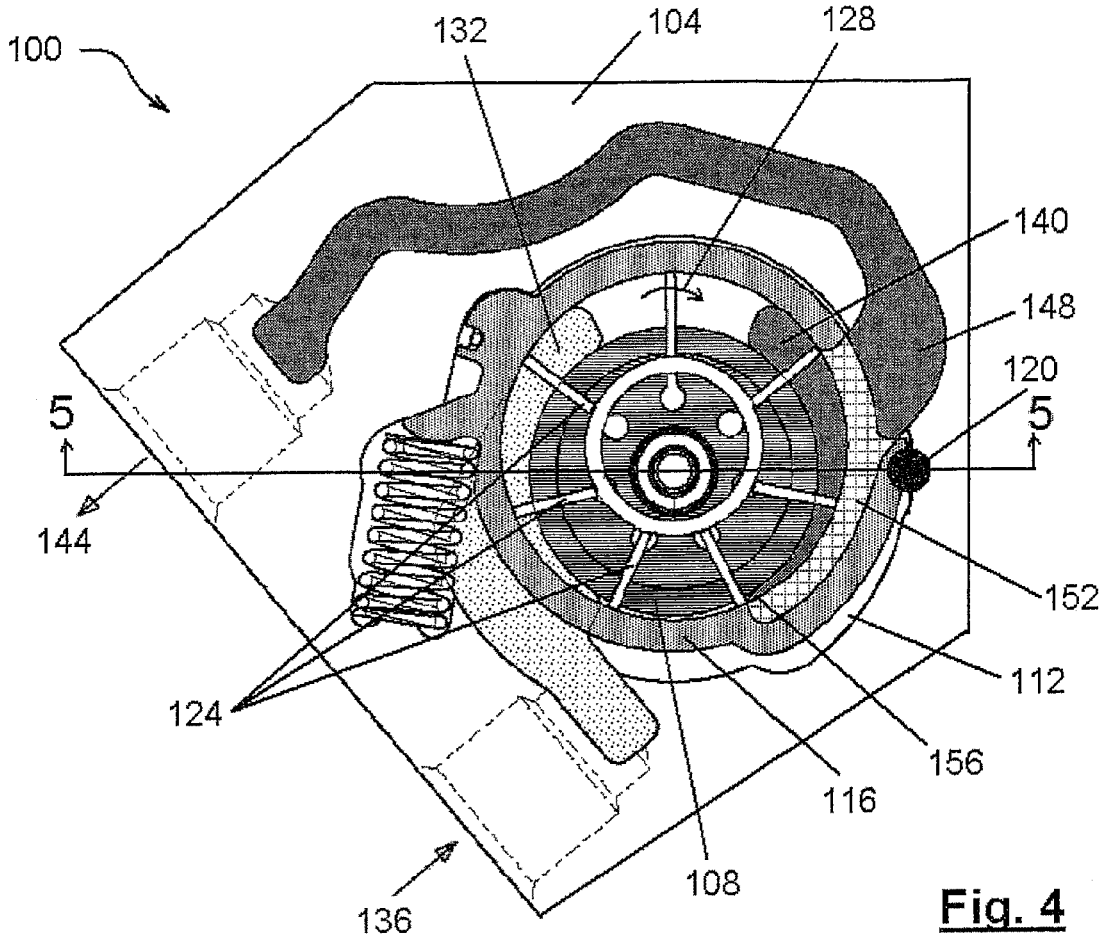
FIG. 4 shows a cross section through a variable displacement vane pump in accordance with the present invention.
Figure 5:
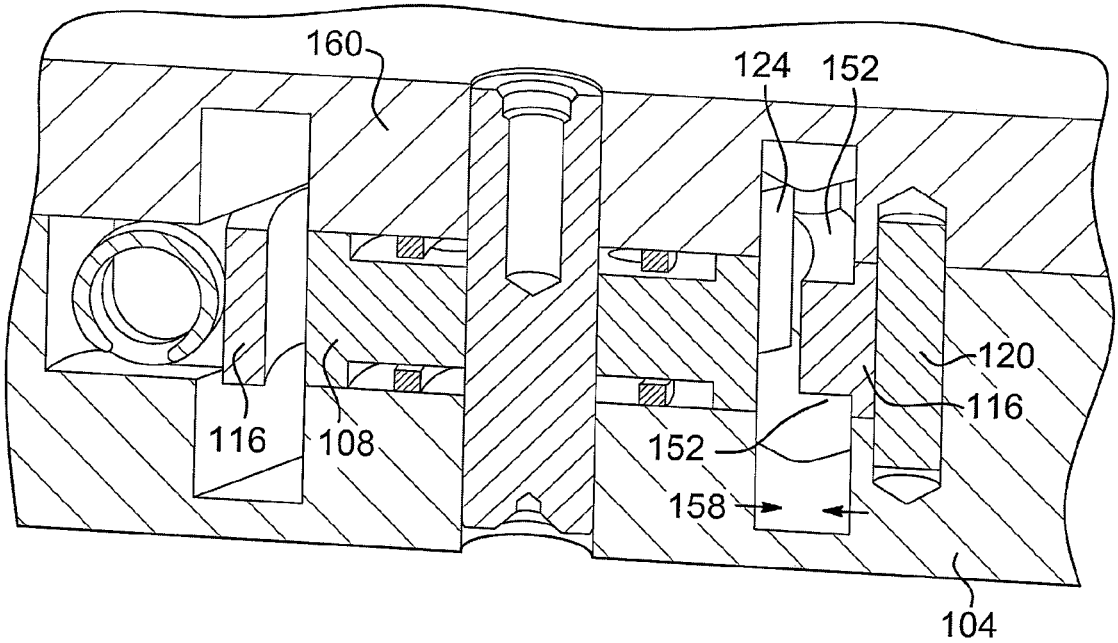
FIG. 5 shows a perspective view of a portion of a cross section taken along line 5-5 of FIG. 4.
Figure 6:
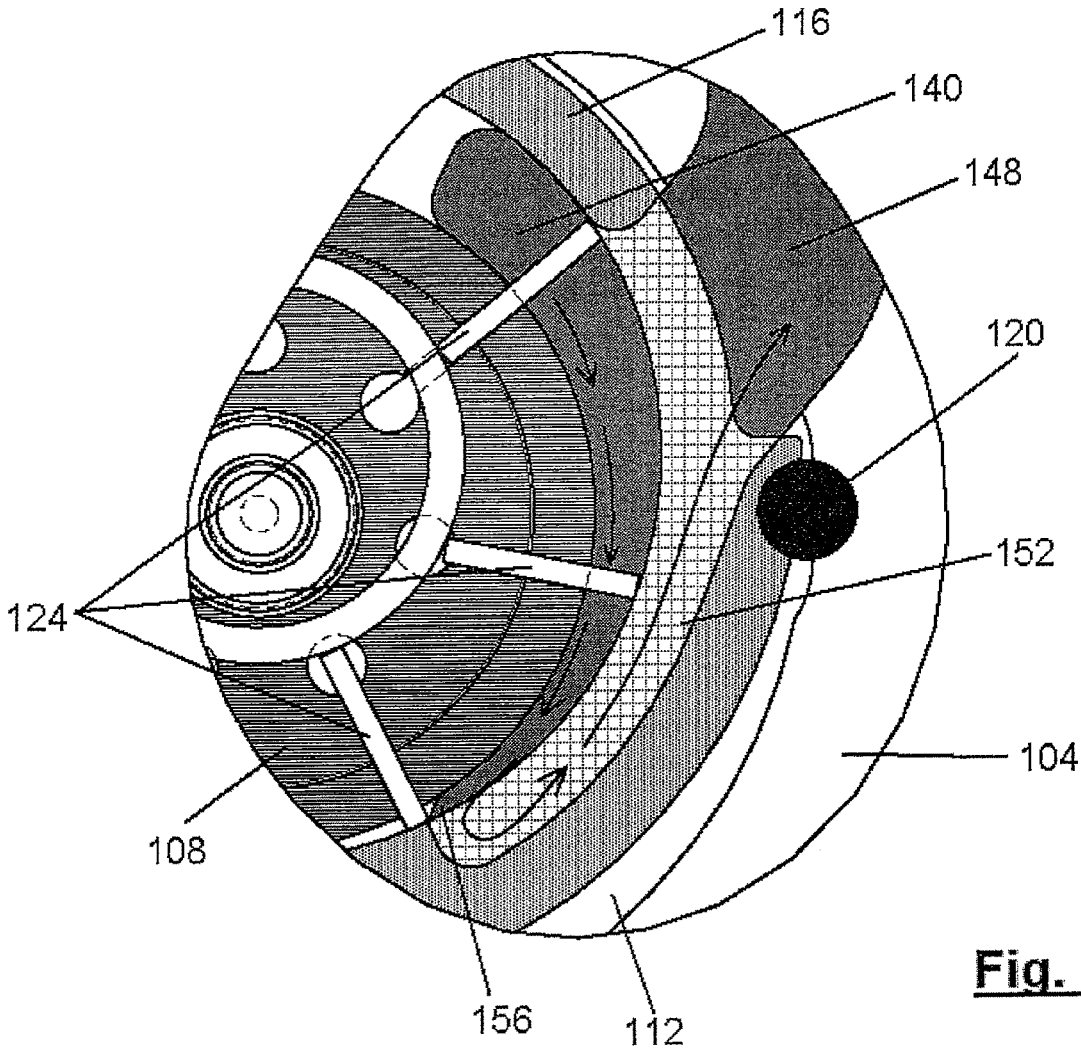
FIG. 6 shows an enlarged view of a portion of the discharge port of the pump of FIG. 4 showing the flow of working fluid.

An embodiment of a variable displacement vane pump, in accordance with the present invention, is indicated generally at 100 in FIGS. 4, 5 and 6. Similar to prior art pump 20, pump 100 includes a pump housing 104 and a rotor 108 which is located within a cavity 112 in housing 104. A control ring 116 is also located within cavity 112 and control ring 116 pivots about a pivot 120 to alter the degree of eccentricity of a set of vanes 124 extending from rotor 108 to change the displacement of pump 100.

As rotor 108 turns, in the direction indicated by arrow 128, working fluid is introduced to the pumping chambers formed between adjacent vanes 124, rotor 108 and control ring 116 via an inlet port 132 which is in fluid communication with a pump inlet 136. Working fluid which has been pressurized within the pumping chambers exits those chambers via a discharge port 140 which is in fluid communication with a pump outlet 144 via a passage 148.

Unlike prior art pump 20, in pump 100 control ring 116 includes a discharge recess 152 which is adjacent to the narrowest end 156 of discharge port 140. Discharge recess 152 has a greater radial width than comparable prior art teardrop recesses 60. Further, unlike teardrop recesses, discharge recess 152 extends from the narrowest end 156 of discharge port 140 past pivot 120 toward the upstream end of discharge port 140 and passage 148. In this manner, discharge port 140 and discharge recess 152 combine to serve as an enhanced discharge port, best seen in FIG. 5.

Figure 3:
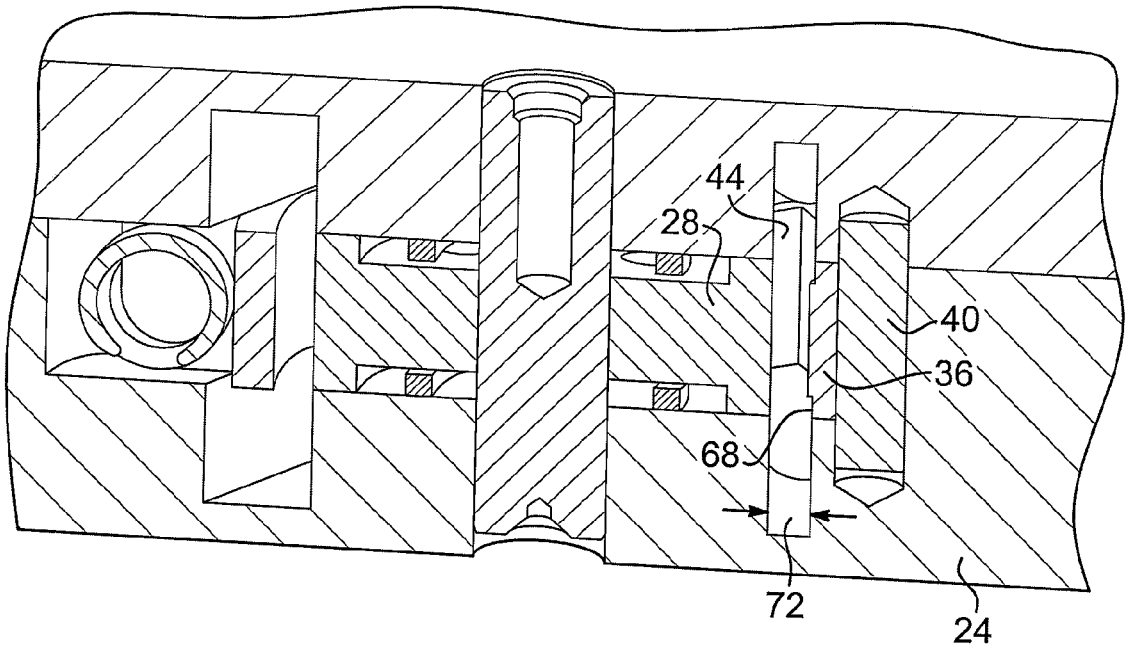
Fig. 3 (prior art)
FIG. 3 shows a perspective view of a portion of a cross section taken along line 3-3 of FIG. 1.

To permit the large width and long length of discharge recess 152, pivot 120 has been moved radially outward, with respect to the center of rotation of rotor 108, such that sufficient material is still available at the top and bottom surfaces of control ring 116 adjacent pivot 120 to provide a sealing surface between control ring 116 and the upper and/or lower surfaces of chamber 112 and/or any covers (such as cover 160 shown in FIG. 5) which are used to enclose chamber 112. By moving pivot 120 radially outward and by providing discharge recess 152, the width 158 of the resulting enhanced discharge port can be significantly greater than the discharge port of prior art pump 20 (as shown in FIG. 3).

FIG. 6 shows the reversal of the direction of the working fluid, as indicated by the arrows, in the enhanced discharge port of pump 100. As is apparent, the relatively large width of discharge recess 152 at narrowest end 156 of discharge port 140 and the radially outward placement of pivot 120 results in a significantly increased volume within which pressurized working fluid can achieve the necessary change of direction. Further, by extending discharge recess 152 past pivot 120, undue constrictions in the flow path of the pressurized working fluid from narrowest end 156 to passage 148 are avoided.

Significant improvements in energy efficiency have been obtained with pump 100, compared to a comparable prior art pump 20, due to the provision of discharge recess 152.

As will be apparent to those of skill in the art, the cross section of discharge recess 152 need not be constant, but it is preferred than any substantial restrictions of the flow of working fluid through discharge recess 152 be avoided. Further, while in the embodiment of pump 100 discussed above, discharge recess 152 is formed in both the upper and lower surface of control ring 116, it is also contemplated that in some circumstances it may be desired to only form discharge recess 152 in one of the upper or lower surfaces of control ring 116.

Figure 7:
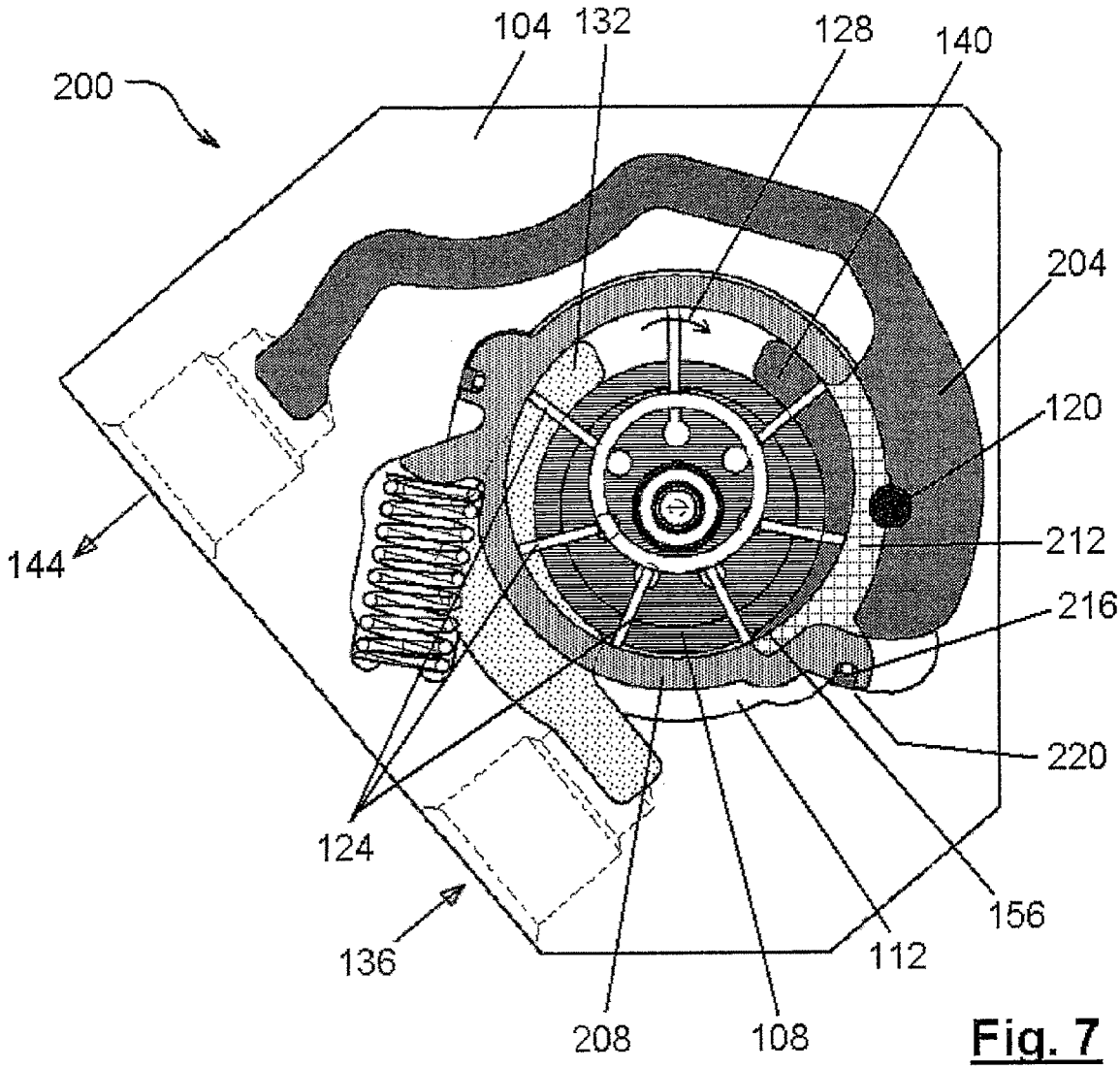
FIG. 7 shows a cross section through another variable displacement vane pump in accordance with the present invention.

FIG. 7 shows another variable displacement vane pump 200 in accordance with the present invention. In pump 200, components which are substantially similar to components of pump 100 are indicated with like reference numerals.

In pump 200, and unlike the case with pump 100, pivot 120 need not be moved radially outward from the rotational center of rotor 108. Instead, pump 200 includes a passage 204, which connects discharge port 140 to pump outlet 144, wherein the mouth of passage 204 surrounds pivot 120. Control ring 208 features a discharge recess 212 which also surrounds pivot 120. In this manner, discharge port 140 and discharge recess 212 combine to serve as an enhanced discharge port.

To provide the necessary sealing to inhibit the migration of pressurized working fluid from the effective discharge port to cavity 112 outside control ring 208, a seal 216 is provided on control ring 208 and seal 216 engages a sealing surface 220 in cavity 112.

Figure 8:
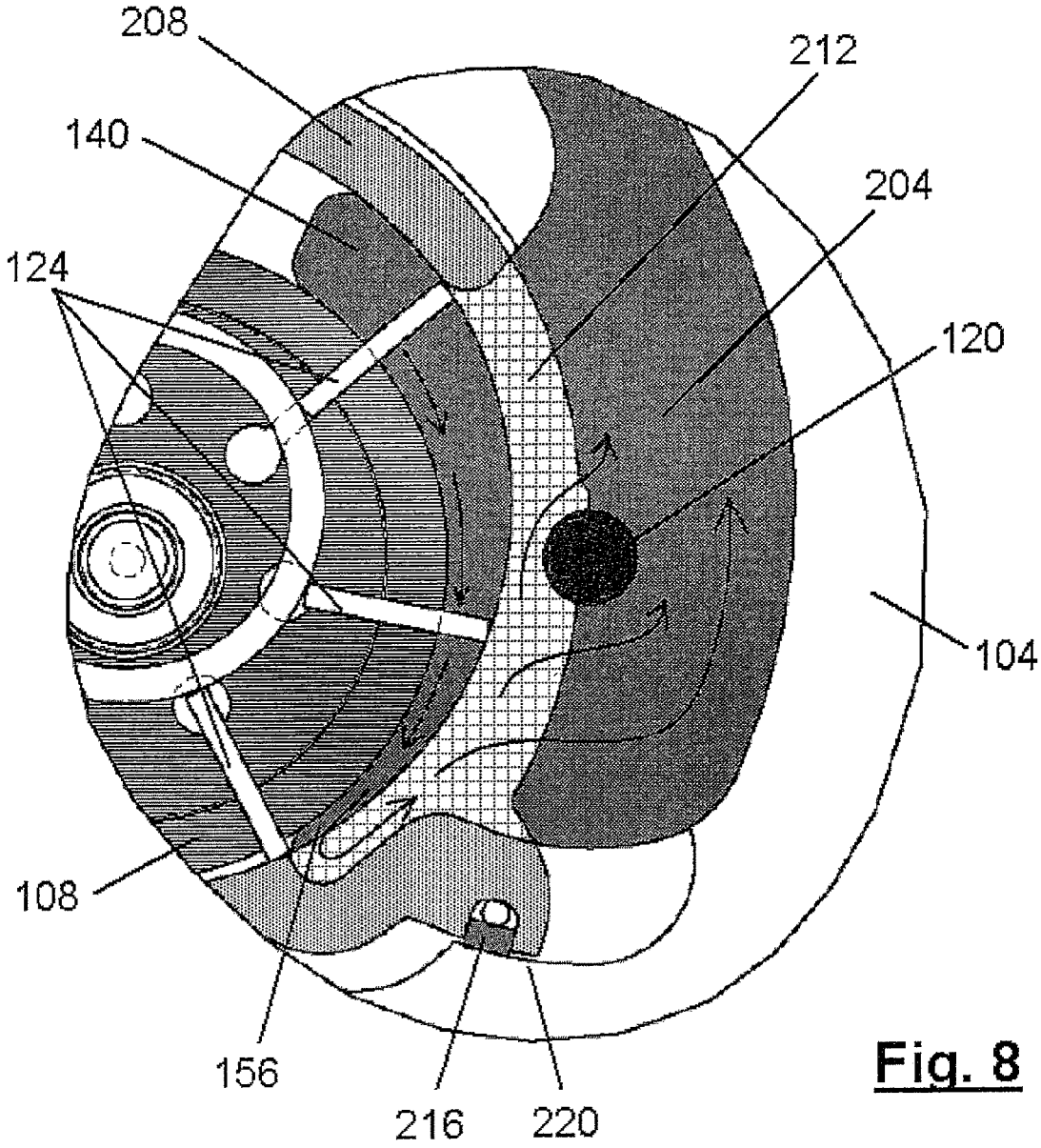
FIG. 8 shows an enlarged view of a portion of the discharge port of the pump of FIG. 7 showing the flow of working fluid.

As indicated in FIG. 8, the width and length of discharge recess 212 provides a relatively large volume in which the pressurized working fluid can reverse direction and enter passage 204 and thus undesired areas of high pressure are avoided, reducing back torque on rotor 108 and increasing the energy efficiency of pump 200.

Figure 9:
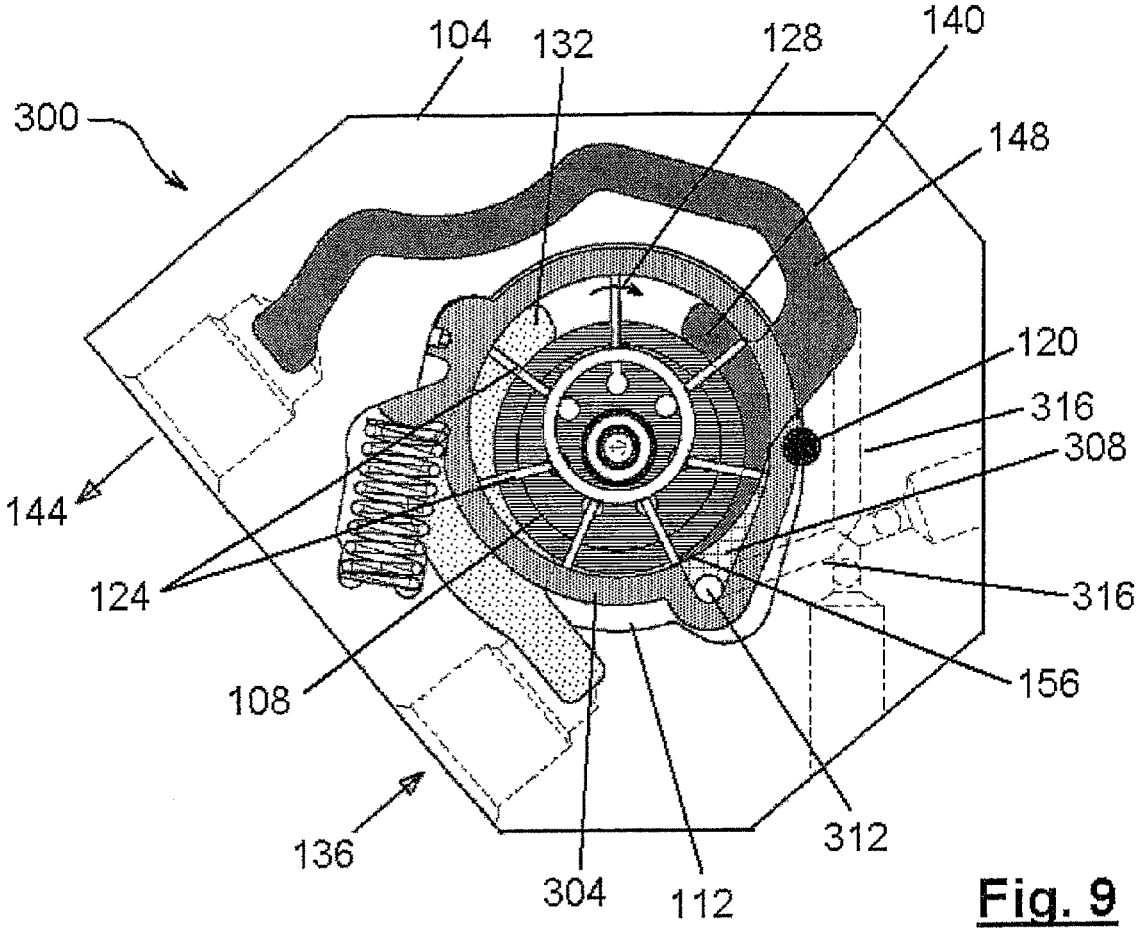
FIG. 9 a cross section through another variable displacement vane pump in accordance with the present invention.

FIG. 9 shows another variable displacement vane pump 300 in accordance with the present invention. In pump 300, components which are substantially similar to components of pump 100 are indicated with like reference numerals.

In pump 300, control ring 304 is formed with a discharge recess 308 which overlies a second discharge port 312 formed in cavity 112. Second discharge port 312 is in fluid communication with passage 148 via one or more secondary passages 316 formed in pump housing 104. The upper and lower instances of discharge recess 308 on control ring 304 are interconnected by another bore (coaxial with second discharge port 312 in the position of control ring 304 shown in FIG. 9) such that working fluid in each discharge recess 308 can enter second discharge port 312. Alternatively, a second discharge port 312 can be provided in pump housing 104 for the lower instance of discharge recess 308 and another second discharge port (not shown) can be provided in the pump cover for the upper instance of discharge recess 308.

In the illustrated embodiment, secondary passages 316 have been bored through pump housing 104 but, as will be understood by those of skill in the art, secondary passages can be formed in a suitable manner and can be formed in pump housing 104 or the pump cover (not shown).

Pressurized working fluid entering discharge recess 308 can exit discharge recess 308 via second discharge port 312 to passage 148, via secondary passages 316, to inhibit the formation of high pressure areas adjacent the downstream end 156 of discharge port 140. Discharge recess 308 and second discharge port 312, in combination with discharge port 140, form an enhanced discharge port and, as with pumps 100 and 200, this enhanced discharge port reduces back torque on rotor 108 and increases the energy efficiency of pump 300.

Figure 10:
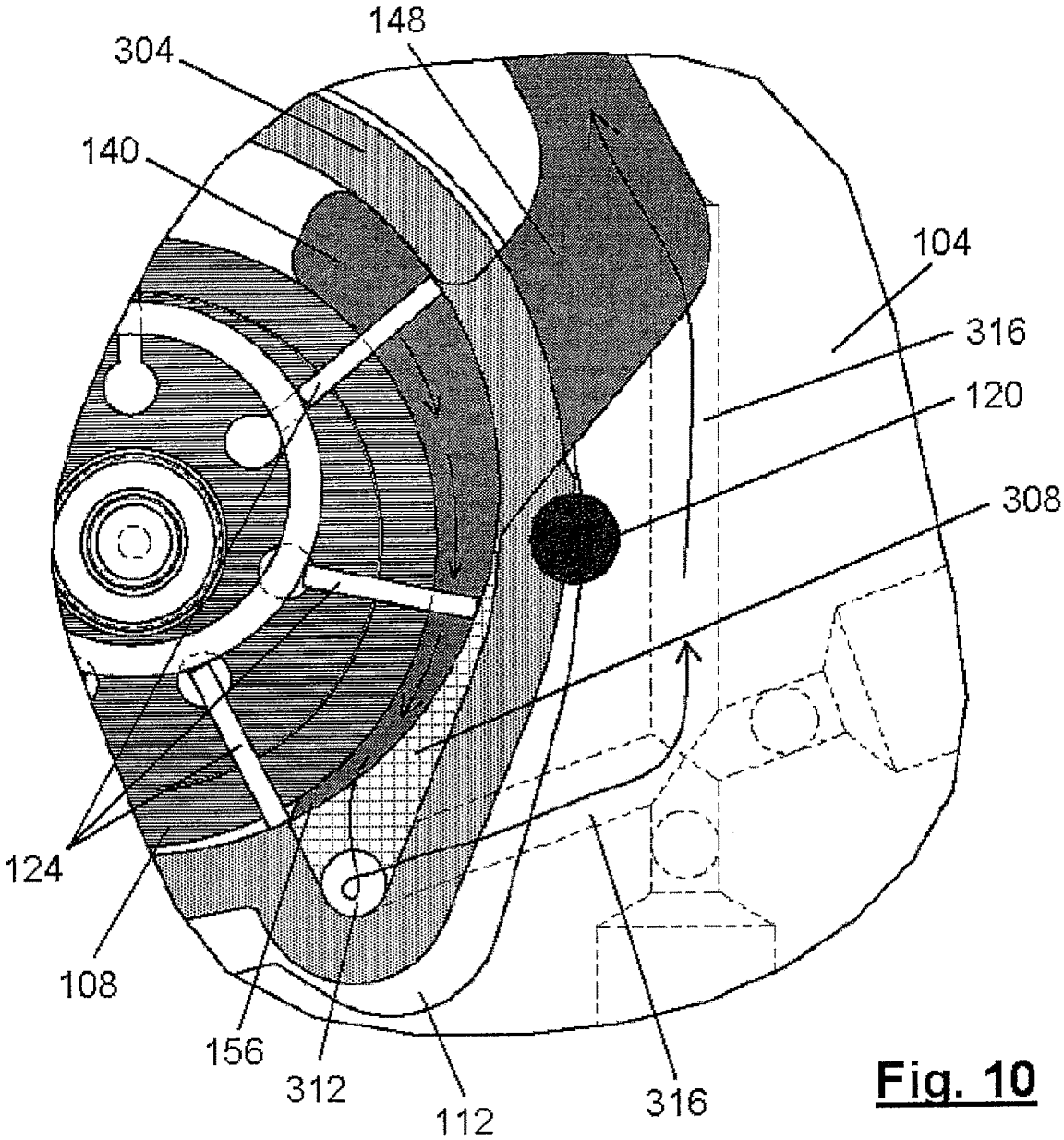
FIG. 10 shows an enlarged view of a portion of the discharge port of the pump of FIG. 9 showing the flow of working fluid.

As shown in FIG. 10, pressurized working fluid from discharge port 140 can enter second discharge port 312 and travel through secondary passages 316 to passage 148 and then to pump outlet 144.

The present invention provides a variable displacement vane pump which includes an enhanced discharge port which reduces areas of high pressure in the discharge port which would otherwise occur as the pressurized working fluid reverses its direction of flow to enter the discharge port. By reducing the areas of high pressure, the back torque on the pump rotor is reduced and the energy efficiency of the pump is enhanced. In one embodiment, the pivot for the pump control ring is located radially outwardly from a conventional location, to allow for a discharge recess to be formed in the control ring, adjacent the discharge port, and extending past the pivot to the pump outlet. In a second embodiment, the discharge recess is formed in the control ring around the pivot and a seal is provided on the control ring to inhibit leakage of pressurized working fluid past the control ring. In a third embodiment, a secondary discharge port is provided adjacent the discharge recess formed in the control ring and pressurized working fluid in the discharge recess can exit the discharge recess through the secondary discharge port which is in fluid communication with the pump outlet.

The above-described embodiments of the invention are intended to be examples of the present invention and alterations and modifications may be effected thereto, by those of skill in the art, without departing from the scope of the invention which is defined solely by the claims appended hereto.

We claim:

1. A variable displacement vane pump, comprising:

a rotor having a set of radially extending vanes;

a control ring having an inner surface against which the vanes abut, adjacent vanes forming pumping chambers with the control ring and the rotor and the control ring being moveable about a pivot to alter the eccentricity between the rotation center of the vanes and the rotation center of the control ring to change the displacement of the pump;

an inlet port to introduce working fluid from a pump inlet to the pumping chambers;

a discharge port located downstream of the inlet port, with respect to the direction of rotation of the rotor, to transfer pressurized working fluid from the pumping chambers to a pump outlet; and a discharge recess formed in at least one of the upper and lower surfaces of the control ring adjacent the discharge port and in fluid communication with the discharge port to form an enhanced discharge port, wherein the discharge recess is in fluid communication with a second discharge port, the second discharge port being in fluid communication with the pump outlet.

2. The variable displacement vane pump of claim 1, wherein the second discharge port is positioned at a downstream end of the discharge recess.

3. A variable displacement vane pump, comprising:

a rotor having a set of radially extending vanes;

a control ring having an inner surface against which the vanes abut, adjacent vanes forming pumping chambers with the control ring and the rotor and the control ring being moveable about a pivot to alter the eccentricity between the rotation center of the vanes and the rotation center of the control ring to change the displacement of the pump;

an inlet port to introduce working fluid from a pump inlet to the pumping chambers;

a discharge port located downstream of the inlet port, with respect to the direction of rotation of the rotor, to transfer pressurized working fluid from the pumping chambers to a pump outlet, the discharge port being connected to the pump outlet with a passage; and a discharge recess formed in at least one of the upper and lower surfaces of the control ring adjacent the discharge port and in fluid communication with the discharge port to form an enhanced discharge port, wherein the discharge recess extends upstream, from the downstream end of the discharge port, to a position upstream of the pivot and into the passage.

4. The variable displacement vane pump of claim 3, wherein the discharge recess extends to a position substantially aligned with an upstream edge of the passage.

5. The variable displacement vane pump of claim 3, wherein the radial width of the discharge recess is substantially one-half the width of the discharge port at a location adjacent the pivot.

6. The variable displacement vane pump of claim 3, wherein the discharge recess circumferentially extends from the downstream end of the discharge port upstream an angle greater than ninety degrees.

7. The variable displacement vane pump of claim 3, wherein the radial width of the discharge recess is substantially constant from the downstream end of the discharge port to a location adjacent the pivot.

8. A variable displacement vane pump, comprising:

a rotor having a set of radially extending vanes;

a control ring having an inner surface against which the vanes abut, adjacent vanes forming pumping chambers with the control ring and the rotor and the control ring being moveable about a pivot to alter the eccentricity between the rotation center of the vanes and the rotation center of the control ring to change the displacement of the pump;

an inlet port to introduce working fluid from a pump inlet to the pumping chambers;

a discharge port located downstream of the inlet port, with respect to the direction of rotation of the rotor, to transfer pressurized working fluid from the pumping chambers to a pump outlet; and a discharge recess formed in at least one of the upper and lower surfaces of the control ring adjacent the discharge port and in fluid communication with the discharge port to form an enhanced discharge port, wherein the discharge recess extends upstream to encompass the pivot.

9. The variable displacement vane pump of claim 8, further including a passage connecting the discharge port and the pump outlet, a mouth of the passage surrounding the pivot.

10. The variable displacement vane pump of claim 9, wherein the discharge recess circumferentially extends to an upstream position aligned with an upstream edge of the passage mouth.

11. The variable displacement vane pump of claim 10, further including a seal inhibiting a flow of pressurized fluid from the discharge recess to a cavity partially defined by an outer circumferential surface of the control ring.

* * * * *